US007276988B2

(12) United States Patent
Stoneham

(10) Patent No.: US 7,276,988 B2
(45) Date of Patent: Oct. 2, 2007

(54) MULTI-SUBSTRATE MICROSTRIP TO WAVEGUIDE TRANSITION

(75) Inventor: Edward B. Stoneham, Los Altos, CA (US)

(73) Assignee: Endwave Corporation, San Jose, CA (US)

( * ) Notice: Subject to any disclaimer, the term of this patent is extended or adjusted under 35 U.S.C. 154(b) by 0 days.

(21) Appl. No.: 10/882,885

(22) Filed: Jun. 30, 2004

(65) Prior Publication Data

US 2006/0001503 A1 Jan. 5, 2006

(51) Int. Cl.
*H01P 5/107* (2006.01)

(52) U.S. Cl. ..... 333/26; 333/33

(58) Field of Classification Search ..... 333/26, 333/33

See application file for complete search history.

(56) References Cited

U.S. PATENT DOCUMENTS

| | | | | |
|---|---|---|---|---|
| 4,453,142 | A | | 6/1984 | Murphy |
| 4,901,040 | A | | 2/1990 | Ahlborn et al. |
| 5,043,683 | A | | 8/1991 | Howard |
| 5,138,436 | A | | 8/1992 | Koepf |
| 5,202,648 | A | | 4/1993 | McCandless |
| 5,235,300 | A | * | 8/1993 | Chan et al. ..... 333/26 |
| 5,414,394 | A | | 5/1995 | Gamand et al. |
| 5,610,563 | A | | 3/1997 | Mohwinkel |
| 5,808,519 | A | * | 9/1998 | Gotoh et al. ..... 333/26 |
| 5,821,815 | A | | 10/1998 | Mohwinkel |
| 5,912,598 | A | * | 6/1999 | Stones et al. ..... 333/26 |
| 6,002,305 | A | | 12/1999 | Sanford et al. |
| 6,040,739 | A | | 3/2000 | Wedeen et al. |
| 6,094,114 | A | | 7/2000 | Mohwinkel |
| 6,239,669 | B1 | * | 5/2001 | Koriyama et al. ..... 333/26 |
| 6,967,542 | B2 | * | 11/2005 | Weinstein ..... 333/26 |
| 2002/0118083 | A1 | | 8/2002 | Pergande |

* cited by examiner

*Primary Examiner*—Benny Lee
(74) *Attorney, Agent, or Firm*—Kolisch Hartwell, P.C.

(57) ABSTRACT

A method and apparatus for coupling a conductor-based transmission line, such as a strip transmission line, to a waveguide. The transmission line may be separated from a corresponding conducting ground plane by a first dielectric substrate layer. The ground plane may be adhesively coupled to a portion of the waveguide, and may be offset from the interior of the waveguide, so that adhesive squeezed out between the ground plane and the waveguide may be at least partially shielded from the waveguide, and thus does not significantly perturb electromagnetic signals within the waveguide.

19 Claims, 3 Drawing Sheets

MULTI-SUBSTRATE MICROSTRIP TO WAVEGUIDE TRANSITION

BACKGROUND

In microwave circuit design, it is often necessary to interface circuit boards with other circuit components such as microwave waveguides. Circuit boards typically communicate via one of various conductor-based transmission lines, such as microstrip, stripline, coplanar waveguide or slotline. Three-dimensional microwave waveguides typically have rectangular or circular cross sections, and are hollow with metallic shells or are filled with a conductive dielectric material. These three-dimensional waveguides are referred to herein as microwave waveguides or simply waveguides.

Adaptors or transitions, also referred to herein as probe launches or simply probes, are mechanisms employed to interface conductor-based transmission lines with waveguides. Such transitions typically suffer from losses due to attenuation and impedance mismatches (reflections), and also may result in perturbations in microwave signals sent or received by the probe.

Conventional transitions to a microwave waveguide are made from stripline or microstrip transmission lines. The transition may be disposed at an end of a microwave waveguide section, or laterally through a side of a microwave waveguide.

DETAILED DESCRIPTION OF THE PREFERRED EMBODIMENTS

Figure 1:
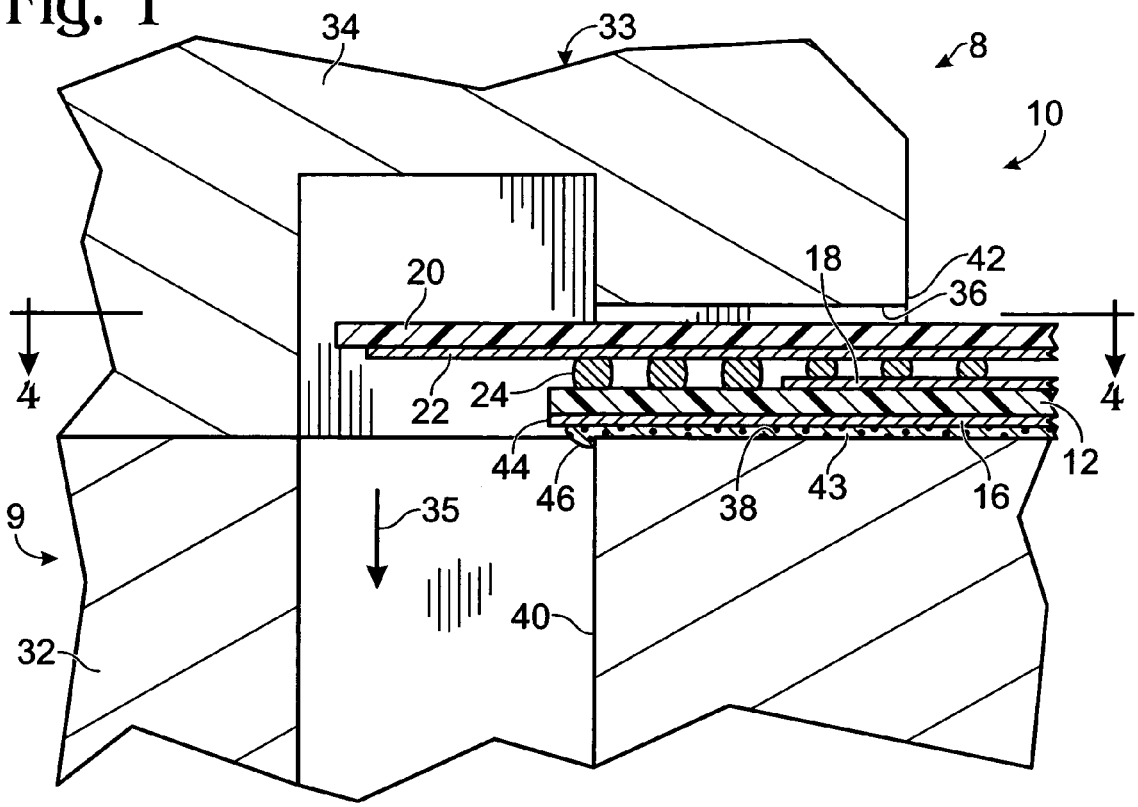
FIG. 1 is a cross section of a waveguide system.

Various embodiments of a transition for interfacing a microwave waveguide with an external circuit are now described in more detail with reference to FIGS. 1-7. In the various figures, like or similar features have the same reference labels. A first embodiment of a waveguide system 8 may include a waveguide 9 and a microstrip to waveguide transition generally indicated at 10 in FIGS. 1-4. Transition 10 may include a substantially planar first dielectric substrate 12, also referred to as a microstrip substrate. Substrate 12 typically has an attached conducting backside or conducting ground plane layer 16. A microstrip signal conductor 18 is formed on a portion of the side of substrate 12 opposite from the conducting ground plane, and is configured to communicate electrical signals between the transition and an external circuit.

A substantially planar second dielectric substrate 20, also referred to as a probe substrate, has an attached conducting probe 22. Substrate 20 may be directly mounted onto substrate 12 using conductive mounting bumps 24, so that probe 22 faces signal conductor 18 and is in electrical contact with the signal conductor through one or more of the mounting bumps. Direct mounting, which may also be referred to as flip mounting, may reduce the length of the electrical connection between the conducting probe and the microstrip signal conductor, since connection through or around a substrate may be avoided. Alternatively, if probe substrate 20 is not directly mounted onto microstrip substrate 12, then probe 22 may make electrical contact with signal conductor 18 through any other suitable means, such as through the use of conducting wires, strip conductors or vias.

Transition 10 may be configured to transmit electrical signals between an external circuit, not shown, and three-dimensional microwave waveguide 9. Waveguide 9 in this example generally includes a metal or otherwise conductive base 32 and a waveguide end 33, shown as a metal or otherwise conductive cover 34. The waveguide end may function as a backshort of waveguide 9, and in some embodiments the base and end may be formed as an integral unit. The waveguide may be shaped such that it defines a substantially hollow interior corresponding to an air dielectric, although in some embodiments the interior of the waveguide maybe filled with a solid or liquid dielectric material. The interior of the waveguide defines a direction of electric field propagation parallel to a first direction longitudinal to the waveguide, represented by arrow 35.

Figure 2:
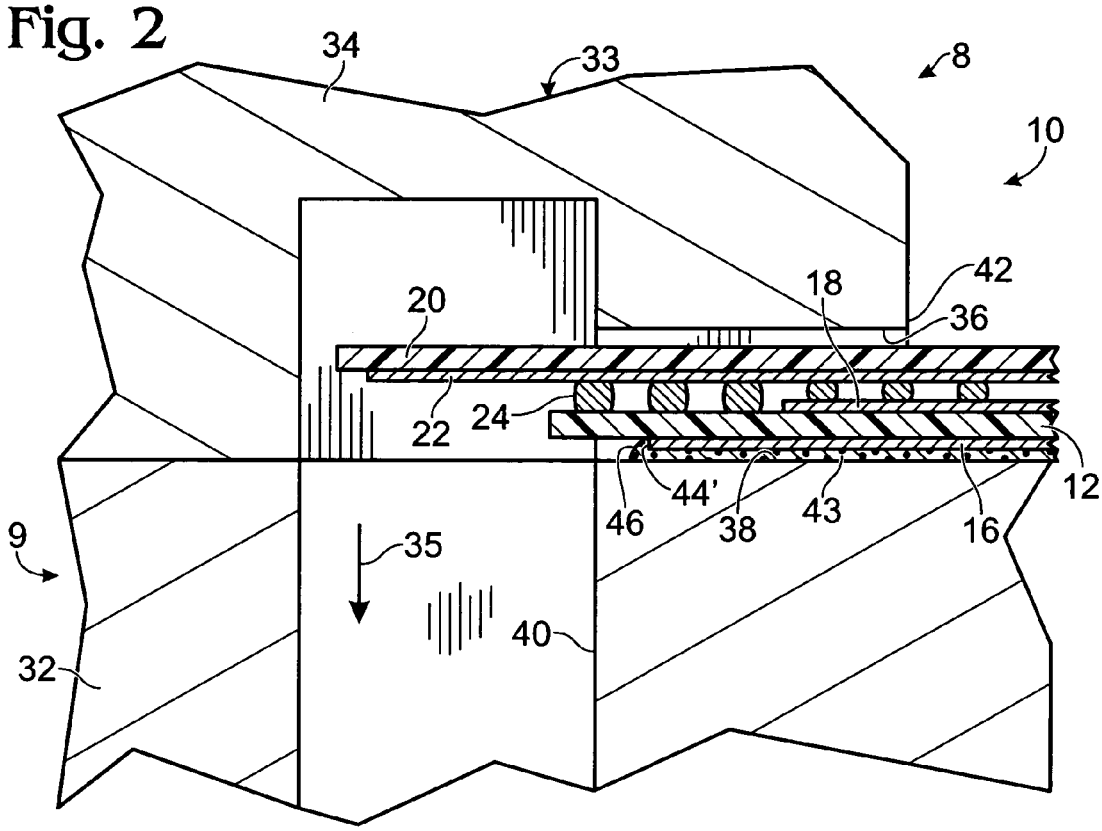
FIG. 2 is a cross section of another waveguide system.

Waveguide 9 may have a transverse opening 36, including a lip 38 having an inner edge 40 and an outer edge 42. Opening 36 may be formed in base 32, in end 33, or in a combination of base 32 and end 33. Opening 36 may be configured to accommodate transition 10, so that the transition may be partially inserted into the waveguide with probe 22 extending over inner edge 40 of lip 38. As depicted in FIGS. 1-2, conducting ground plane 16 of the transition may be adhesively bonded to lip 38 by an adhesive layer 43 to fix the transition in place, in such a manner that conducting probe 22 extends into the interior of the waveguide. In this configuration, signals from an external circuit may be transmitted to signal conductor 18, through mounting bumps 24, and to probe 22, which radiates the signal into the waveguide. Conversely, radiated signals received by the waveguide (e.g., via a microwave receiver coupled to an end of the waveguide opposite the probe) may be partially absorbed by probe 22 and then transmitted through mounting bumps 24 to signal conductor 18, and thus to the external circuit.

As indicated in FIG. 1, a leading edge 44 of conducting ground plane 16 may by offset from inner edge 40 of lip 38, such that the leading edge extends slightly beyond edge 40 and into the hollow interior of the waveguide. Thus, adhesive 46 squeezed out from the interface between the conducting ground plane and the lip will be shielded from probe 22 by the ground plane. Since the presence of the conducting ground plane alters the microwave signal in a predictable way, whereas the presence of unshielded adhesive would generally perturb the signal in an unpredictable way, this configuration has the advantage that the squeezed out adhesive will not substantially interfere with microwave signals being communicated between the waveguide and the external circuit.

Alternatively, as indicated at 44' in FIG. 2, leading edge 44' of ground plane 16 may be recessed from inner edge 40. In that case, adhesive 46' squeezed out from the interface between the conducting ground plane and the lip will be shielded from probe 22 by base 32, so that again the squeezed out adhesive will not substantially interfere with microwave signals being transferred between the waveguide and the external circuit.

Figure 3:
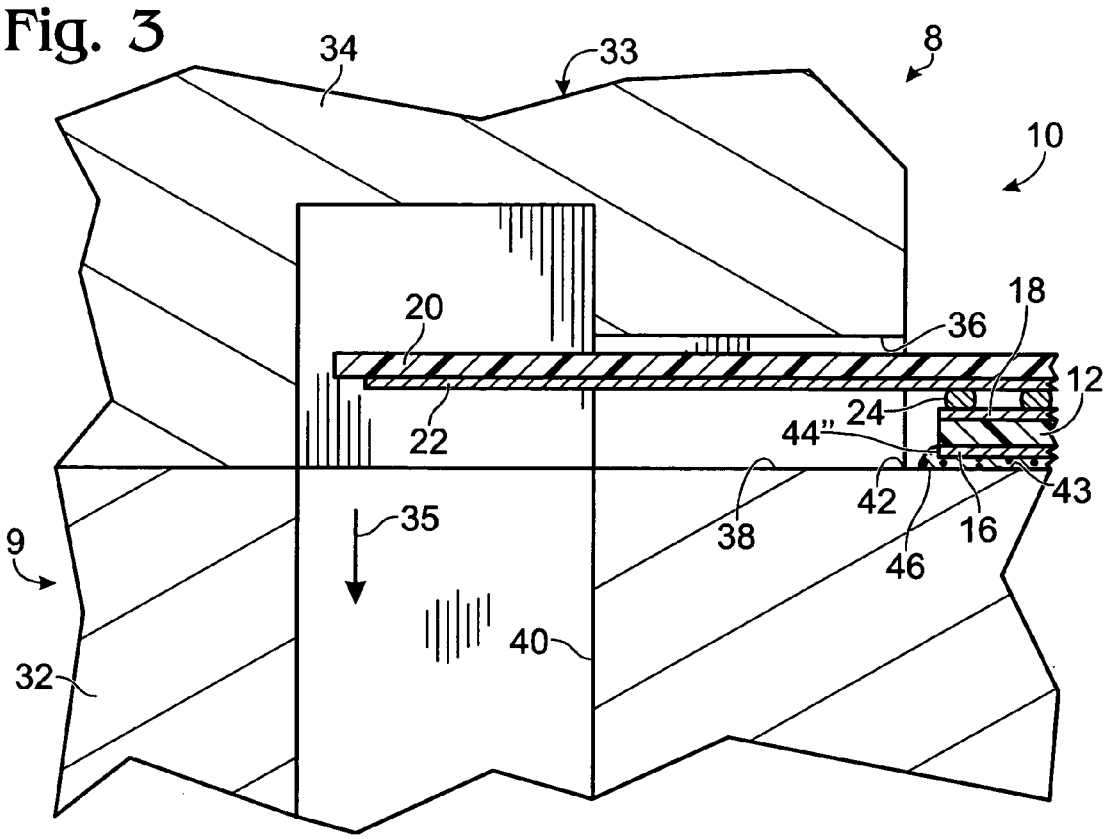
FIG. 3 is a cross section of yet another waveguide system.

A third alternative is indicated at 44" in FIG. 3, which shows the leading edge of ground plane 16 recessed so that it ends short of outer edge 42, and thus does not enter opening 36. This configuration shares the advantage of the previously described configurations with regard to shielding of any squeezed out adhesive from the probe. Additionally, since substrate 12 need not fit through opening 36, substrate 12 and conducting ground plane 16 may have widths greater than the width of opening 36, allowing the substrate to have any desired dimensions regardless of the width of the opening.

Figure 4:
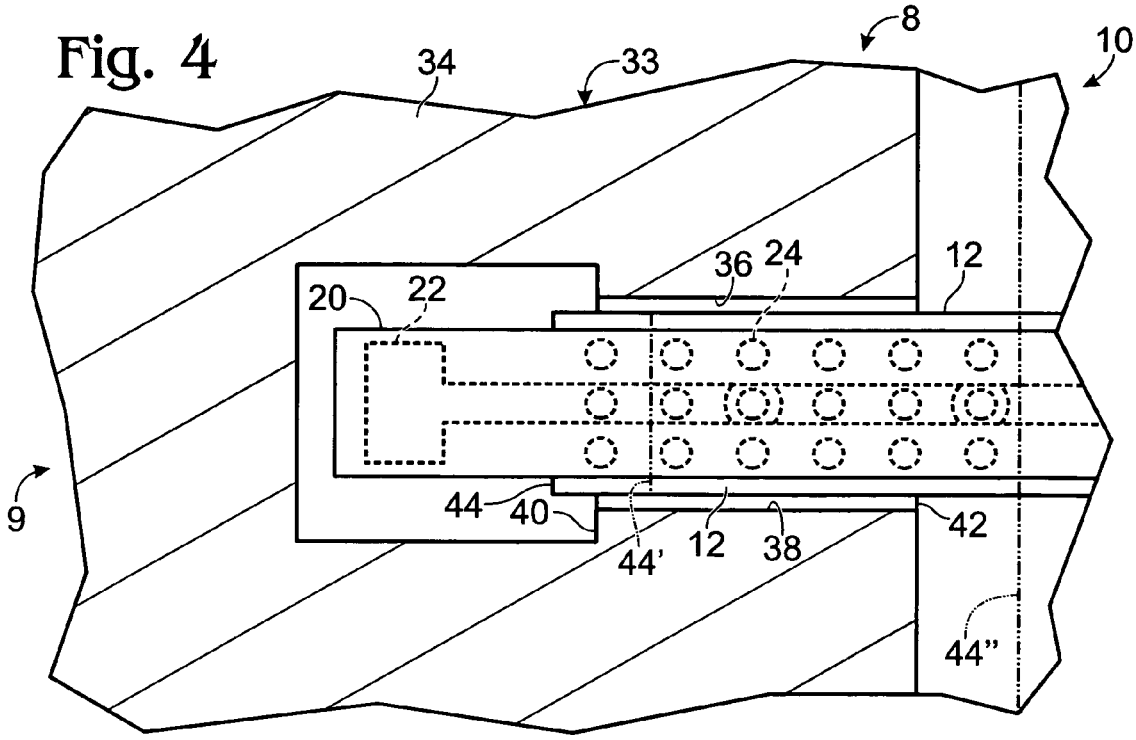
FIG. 4 is a cross section taken along line 4-4 in FIG. 1.

FIG. 4 shows a sectional view taken along the line 4-4 in FIG. 1. As depicted in FIG. 4, conducting probe 22 may be paddle shaped, with a head portion 50 and an elongate neck portion 52. As indicated, one or more of mounting bumps 24 may couple probe 22 to microstrip conductor 18, whereas others of the mounting bumps may couple probe substrate 20 to microstrip conductor 18 and/or to microstrip substrate 12, depending on the distribution of the mounting bumps and on the relative widths of the probe, the microstrip conductor, and the two substrates.

FIG. 4 depicts leading edge 44 of ground plane 16 extending partially beyond inner edge 40 of lip 38, corresponding to the offset of the ground plane shown in the embodiment of FIG. 1. For reference, dashed line 44' in FIG. 4 indicates how the leading edge of the ground plane may alternatively be recessed from inner edge 40, as depicted in FIG. 2. Similarly, dashed line 44" in FIG. 4 indicates how the leading edge of the ground plane may be recessed so far as to lie completely out of opening 36, in which case the ground plane and/or the microstrip substrate may each have widths greater than the width of the opening, as indicated by the extended width of line 44".

Figure 5:
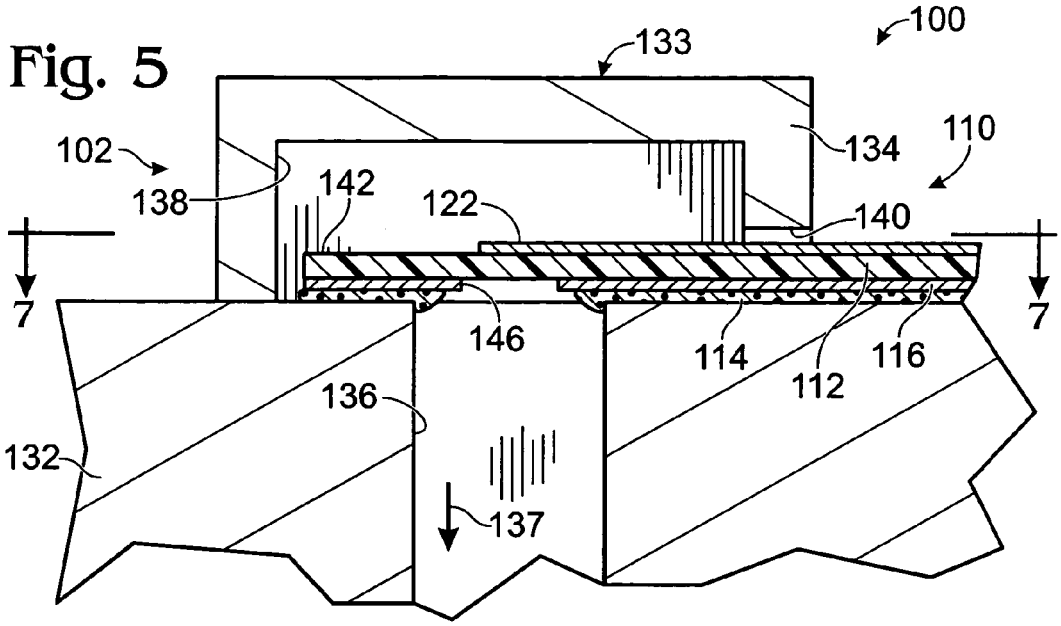
FIG. 5 is a cross section of another waveguide system.
Figure 6:
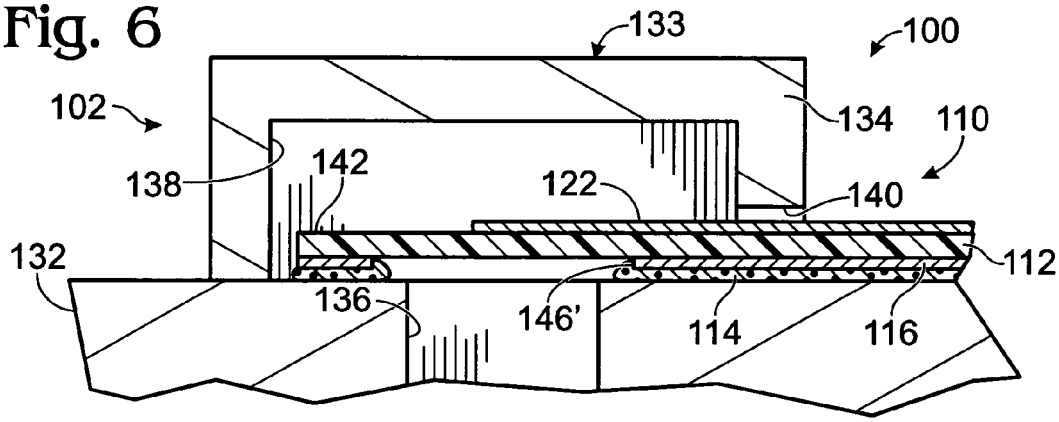
FIG. 6 is a cross section of yet another waveguide system.
Figure 7:
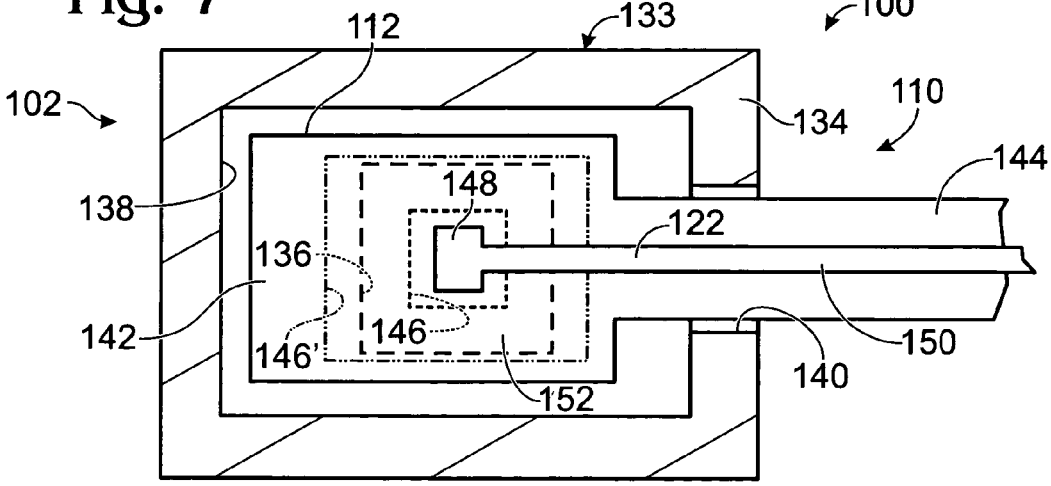
FIG. 7 is a cross section taken along line 7-7 of FIG. 5.

FIGS. 5-7 show additional embodiments of a waveguide system 100 including a waveguide 102 and a microstrip-to-waveguide transition 110. In these embodiments, waveguide transition 110 may include a substantially planar microstrip substrate 112, and a conducting backside or ground plane layer 116 attached to the substrate. A microstrip conducting probe 122 may be formed on a portion of the side of substrate 112 opposite from the conducting ground plane, and may be configured to transmit electrical signals between waveguide 102 and an external circuit (not shown).

Waveguide 102 may include a metal or otherwise conductive base 132 and a waveguide end 133, shown as a metal or otherwise conductive a removable cover 134. The waveguide end may function as a backshort of waveguide 102. A first aperture 136 in base 132 may define a substantially hollow interior of the waveguide, although as previously mentioned, in some embodiments the interior of the waveguide may be filled with a dielectric material. The interior of the waveguide defines a direction of electric field propagation, represented by arrow 137 (FIG. 5), parallel to a first direction longitudinal to the waveguide. Cover 134 may define a hollow recess 138 greater in cross-sectional area than the area of aperture 136, and the cover may be configured to seat directly onto the base and to substantially enclose aperture 136. The cover further defines a transverse opening 140 configured to accept a portion of transition 110 when the cover is in place. Opening 140 may also be in base 132, or in a combination of base 132 and cover 134.

As is particularly seen in FIG. 7, substrate 112 may be generally paddle shaped, with a head portion 142 having an area greater than the area of aperture 136 but less than the cross-sectional area of recess 138, and a neck portion 144 (FIG. 7) sized to fit within opening 140 having a width, in this embodiment, less than the widths of substrate 112 and aperture 136. Thus, substrate 112 may be placed so as to completely cover aperture 136 without interfering with the seating of cover 134 directly onto base 132. Conducting ground plane 116 of substrate 112 may be adhesively bonded by an adhesive layer 114 to base 132 within recess 138 so as to fix transition 110 in position. A portion of ground plane 116 may be cut out to define a second aperture 146 configured to allow passage of microwaves between the interior portion of the waveguide and recess 138, and thus between the waveguide and probe 122.

As indicated in FIGS. 5-7, probe 122 may also be paddle shaped, including a head portion 148 smaller than the area of aperture 146, and a neck portion 150 sized to fit within opening 140. This allows the probe to be formed on substrate 112 without interfering with the seating of cover 134 onto base 132. Head portion 148 of the probe is disposed at least partially overlapping aperture 146, so that microwaves may be transmitted between the probe and the interior of the waveguide.

To avoid unpredictable signal perturbations from adhesive squeezed out at the interface of conducting ground plane 116 and base 132, aperture 146 in the ground plane may be offset in some manner from aperture 136 in the base of the waveguide. For example, as indicated in FIG. 5, aperture 146 may be smaller than aperture 136, resulting in an overlapping region 152 in which any adhesive is effectively screened from probe 122 by the overlapping portion of conducting ground plane 116. Alternatively, as indicated at 146' in FIGS. 6 and 7, the aperture in ground plane 116 may be larger than aperture 136, so that squeezed out adhesive would be disposed on top of base 132 and would therefore not interfere with microwaves in the interior of the waveguide.

It should be appreciated that in the embodiments depicted in FIGS. 5-7, substrate 112 and/or ground plane 116 may completely cover aperture 136 in the waveguide, forming a seal that may be substantially watertight and/or airtight. Since a distal end of the waveguide may terminate at, for example, an outdoor microwave antenna or dish, it is sometimes the case that water, dust, and various contaminants may enter the waveguide. Thus, by forming a seal at the interface of transition 110 and aperture 136, these undesirable elements may be substantially trapped on the side of the transition opposite the microstrip conductor and the external circuit. This may prevent undesirable damage or wear to those elements.

Accordingly, while embodiments have been particularly shown and described with reference to the foregoing disclosure, many variations may be made therein. The foregoing embodiments are illustrative, and no single feature or element is essential to all possible combinations that may be used in a particular application. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate or imply a required or limited number of such elements, and do not indicate a particular position or order of such elements unless otherwise specifically stated.

INDUSTRIAL APPLICABILITY

The methods and apparatus described in the present disclosure are applicable to the telecommunications and other communication frequency signal processing industries involving the transmission of signals between circuits or circuit components.

I claim:

1. A transition for interfacing a microwave waveguide with an external circuit, the waveguide having a substantially hollow interior with an opening including a lip having an inner edge and an outer edge, the waveguide further defining a direction of electric field propagation parallel to a first direction, the transition comprising:

a first substrate extending in a plane substantially transverse to the first direction;

a conducting ground plane attached to the first substrate;

a microstrip signal conductor attached to the first substrate and separated from the ground plane by the first substrate;

a second substrate disposed substantially parallel to the first substrate, the second substrate extending at least partially into the interior of the waveguide; and a conducting probe attached to the second substrate and mounted directly onto the signal conductor, the probe extending at least partially into the interior of the waveguide in a plane substantially transverse to the first direction.

2. The transition of claim 1, further comprising an adhesive layer between the ground plane and at least a portion of the lip, the adhesive layer attaching the ground plane to at least the portion of the lip.

3. The transition of claim 1, wherein the conducting ground plane has a leading edge, and the leading edge is offset from the inner edge of the lip.

4. The transition of claim 3, wherein the leading edge of the conducting ground plane extends beyond the inner edge of the lip and into the interior of the waveguide.

5. The transition of claim 3, wherein the leading edge of the conducting ground plane is recessed from the inner edge of the lip.

6. The transition of claim 3, further comprising conductive adhesive between the leading edge of the ground plane and the inner edge of the lip.

7. The transition of claim 1, wherein the probe is directly mounted to the signal conductor with a plurality of conductive mounting bumps.

8. The transition of claim 7, wherein the second substrate is mounted to the first substrate with at least one mounting bump.

9. A transition for interfacing a microwave waveguide with an external circuit, the waveguide having a substantially hollow interior with an opening including a lip having an inner edge and an outer edge, the waveguide further defining a direction of electric field propagation parallel to a first direction, the transition comprising:

a first substrate defining a plane substantially transverse to the first direction;

a conducting ground plane attached to the first substrate and having a leading edge offset from the inner edge of the lip;

a microstrip signal conductor attached to the first substrate and separated from the ground plane by the first substrate;

a second substrate disposed substantially parallel to the plane of the first substrate, the second substrate extending at least partially into the interior of the waveguide; and a conducting probe attached to the second substrate and in electrical contact with the signal conductor, the probe extending at least partially into the interior of the waveguide in a plane substantially transverse to the first direction.

10. The transition of claim 9, further comprising an adhesive layer between the ground plane and at least a portion of the lip, the adhesive layer attaching the ground plane to the at least a portion of the lip, and the leading edge of the conducting ground plane is sufficiently offset from the inner edge of the lip such that adhesive extending out from an interface between the conducting ground plane and the lip does not substantially perturb microwave signals being transferred between the waveguide and the external circuit.

11. The transition of claim 9, wherein the conducting ground plane is adhesively bonded to at least a portion of the lip, and the leading edge of the conducting ground plane extends beyond the inner edge of the lip and into the interior of the waveguide.

12. The transition of claim 9, wherein the conducting ground plane is adhesively bonded to at least a portion of the lip, and the leading edge of the conducting ground plane is recessed from the inner edge of the lip.

13. The transition of claim 9, wherein the leading edge of the conducting ground plane ends short of the outer edge of the lip.

14. The transition of claim 13, wherein the opening has a first width, the first substrate and the conducting ground plane each have widths greater than the first width.

15. A microwave waveguide system comprising:

a waveguide base having a planar top surface and a hollow interior portion defined by a first aperture in the top surface, the interior portion having a first cross-sectional area and defining a direction of electric field propagation parallel to a first direction;

a transition for interfacing the waveguide with an external circuit, the transition mounted on the planar top surface of the waveguide base and configured to extend at least partially over the first aperture in a direction transverse to the first direction, the transition including:

a substantially planar substrate having an enlarged end with a third cross-sectional area greater than the first area and less than the second area, the enlarged end configured to cover the first aperture, the substrate having a reduced neck configured to fit through the transverse opening; and a conducting ground plane attached to the substrate and an adhesive layer between the ground plane and at least a portion of the top surface of the waveguide base, the adhesive layer attaching the ground plane to at least a portion of the top surface of the waveguide base, the ground plane defining a second aperture configured to allow passage of microwaves between the interior portion of the waveguide and the recess of the cover, wherein the conducting ground plane is offset from the first aperture and adhesive extends out from an interface between the ground plane and the top surface of the base and does not substantially perturb microwave signals being transferred between the waveguide and the external circuit; and a waveguide end defining a hollow recess, the recess having a second cross-sectional area greater than the first area and accommodating the transition, the waveguide end surrounding the first aperture, mounted to and extending from the planar top surface of the waveguide base, and having a transverse opening extending from the recess and through which the transition extends.

16. The waveguide system of claim 15, wherein the conducting ground plane extends partially over the first aperture.

17. The waveguide system of claim 15, wherein the conducting ground plane is recessed from the first aperture.

18. The waveguide system of claim 15, wherein the transition further includes a conducting probe attached to the substrate and configured to be in electrical contact with the external circuit by passing through the transverse opening, the probe extending at least partially over the first and second apertures.

19. The waveguide system of claim 15, wherein the transition is configured to seal the first aperture.

* * * * *